US006305132B1

(12) United States Patent
Smith

(10) Patent No.: US 6,305,132 B1
(45) Date of Patent: Oct. 23, 2001

(54) MOLDED INTERIOR WINDOW FRAME ASSEMBLY

(76) Inventor: Mark C. Smith, 835 N. Central Ave., Wood Dale, IL (US) 60191-1291

( * ) Notice: Subject to any disclaimer, the term of this patent is extended or adjusted under 35 U.S.C. 154(b) by 0 days.

(21) Appl. No.: 09/511,016

(22) Filed: Feb. 23, 2000

(51) Int. Cl.[7] ..... E06B 1/04

(52) U.S. Cl. ..... 52/204.1; 52/656; 52/204.5; 52/202

(58) Field of Search ..... 52/212, 656.4, 52/656.5, 656.9, 734.1, 745.16, 745.2, 204.53, 211, 213

(56) References Cited

U.S. PATENT DOCUMENTS 4,228,630 * 10/1980 Englert et al. ..... 52/656
4,811,533 3/1989 Wetsel .
5,014,466 5/1991 Winner .
5,487,243 * 1/1996 Hale et al. ..... 52/202
5,921,037 * 7/1999 Minter ..... 52/204.5
5,983,579 11/1999 Young .

OTHER PUBLICATIONS

Hawley's Condensed Chemical Dictionary, Irving N. Sax, 1987, Van Nostrand Reinhold Company, 181–192.*

* cited by examiner

*Primary Examiner*—Carl D. Friedman
*Assistant Examiner*—Steve Varner
(74) *Attorney, Agent, or Firm*—Mark E. Wiemelt

(57) ABSTRACT

The present invention relates to a four piece molded acrylic kit and method for trimming an interior window. Each piece is oversized in order to be cut down and fitted onto the existing window jamb. The pieces overlap and create a water barrier once the kit is sealed. Each piece is dimensioned, arranged, and interconnected to cover the window jamb and the wall surface that circumscribes the window opening. The pieces are attached to the window jamb by butyl tape and finished with silicone and a sealant finisher.

3 Claims, 7 Drawing Sheets

MOLDED INTERIOR WINDOW FRAME ASSEMBLY

BACKGROUND OF THE INVENTION

1. Field of the Invention

The present invention relates to a new and improved molded interior window frame assembly. More specifically, the invention is directed to a four piece molded interior window frame assembly kit comprised of acrylic for use on a bathroom window which is watertight and resistant to mold or mildew.

2. Description of the Related Art

In most bathrooms, wood fascia trim or vinyl cladding which is mitered is installed over the window jamb which surrounds a window. However, both of these prior art devices have been found wanting in one or more particulars. Humidity in the bathroom can cause the fascia trim to rot and deteriorate, which can allow water to leak behind the walls. In addition, the porous wood also helps bacteria found in molds and mildew to flourish and spread, which can potentially cause several health hazards and allergies.

Vinyl cladding is also not appropriate for use in a bathroom as the mitered corners are prone to separation. This can create a path for water to run behind the walls. If any water or moisture gets behind the walls, it can cause leaking, mold, mildew, pest infestation, rotting and/or damage to the home's interior structure.

Hence, there is a need in the art for a molded interior window frame assembly which protects the existing window jamb which surrounds a window. There is also a need in the art for a molded interior window frame which is not prone to separation at its corners. There is also a need in the art for a molded interior window frame assembly which is watertight and prevents leakage.

It is a primary object of the present invention to provide a molded interior window frame assembly which is quick and easy to install.

A further object of the present invention is to provide a molded interior window frame assembly which is watertight.

Another objective of the instant invention is to provide a molded interior window frame assembly which is comprised of a material which is resistant to mold or mildew.

A further object of the present invention is to provide a molded interior window frame assembly with a complementary or pleasing appearance.

Another object of the instant invention is to provide a molded interior window frame assembly which will fit a variety of window styles and sizes.

A further object of the present invention is to provide a molded interior window frame assembly which is easy to remove.

It is therefore an object of the present invention to provide an improved molded interior window frame assembly which has all the advantages of the prior art and none of its disadvantages.

These together with other objects of the invention, along with the various features of novelty which characterize the invention, are pointed out with particularity in the detailed description annexed to and forming a part of this disclosure. For a better understanding of the invention, its operating advantages and the specific objects attained by its uses, reference should be had to the accompanying drawings and descriptive matter in which there is illustrated a preferred embodiment of the invention.

SUMMARY OF INVENTION

A broad aspect of the invention comprises a molded interior window frame assembly. One embodiment of the invention utilizes four identical acrylic molding sections each having an upper end and a lower end. The molding sections are dimensioned, arranged, and interconnected to cover the window jamb and the wall surface which circumscribes a window opening. Each molding section includes a front portion, a jamb portion, a trim portion, and a cap.

The window frame assembly is constructed by dimensioning the molding sections and arranging them in a counterclockwise direction over the window jamb surrounding a window opening. The molding sections are then attached to the window jamb and its surrounding wall surface by butyl tape and silicone. Silicone is also applied around the inside and outside edges of the window frame assembly. A sealant finisher is used to smooth the silicone.

There has thus been outlined, rather broadly, the more important features of the invention in order that the detailed description thereof that follows may be better understood, and in order that the present contribution to the art may be better appreciated. There are, of course, additional features of the invention that will be described hereinafter and that will form the subject matter of the invention. Those skilled in the art will appreciate that the conception, upon which this disclosure is based, may readily be utilized as a basis for the designing of other devices for carrying out the several purposes of the present invention. It is important, therefore, that the invention be regarded as including such equivalent constructions insofar as they do not depart from the spirit and scope of the present disclosure.

BRIEF DESCRIPTION OF THE SEVERAL VIEWS OF THE DRAWINGS

The foregoing and other additional objects of the present invention will be readily appreciated by those skilled in the art upon gaining an understanding of the invention as described in the following detailed description and shown in the accompanying drawings in which.

DETAILED DESCRIPTION OF THE INVENTION

Figure 1:
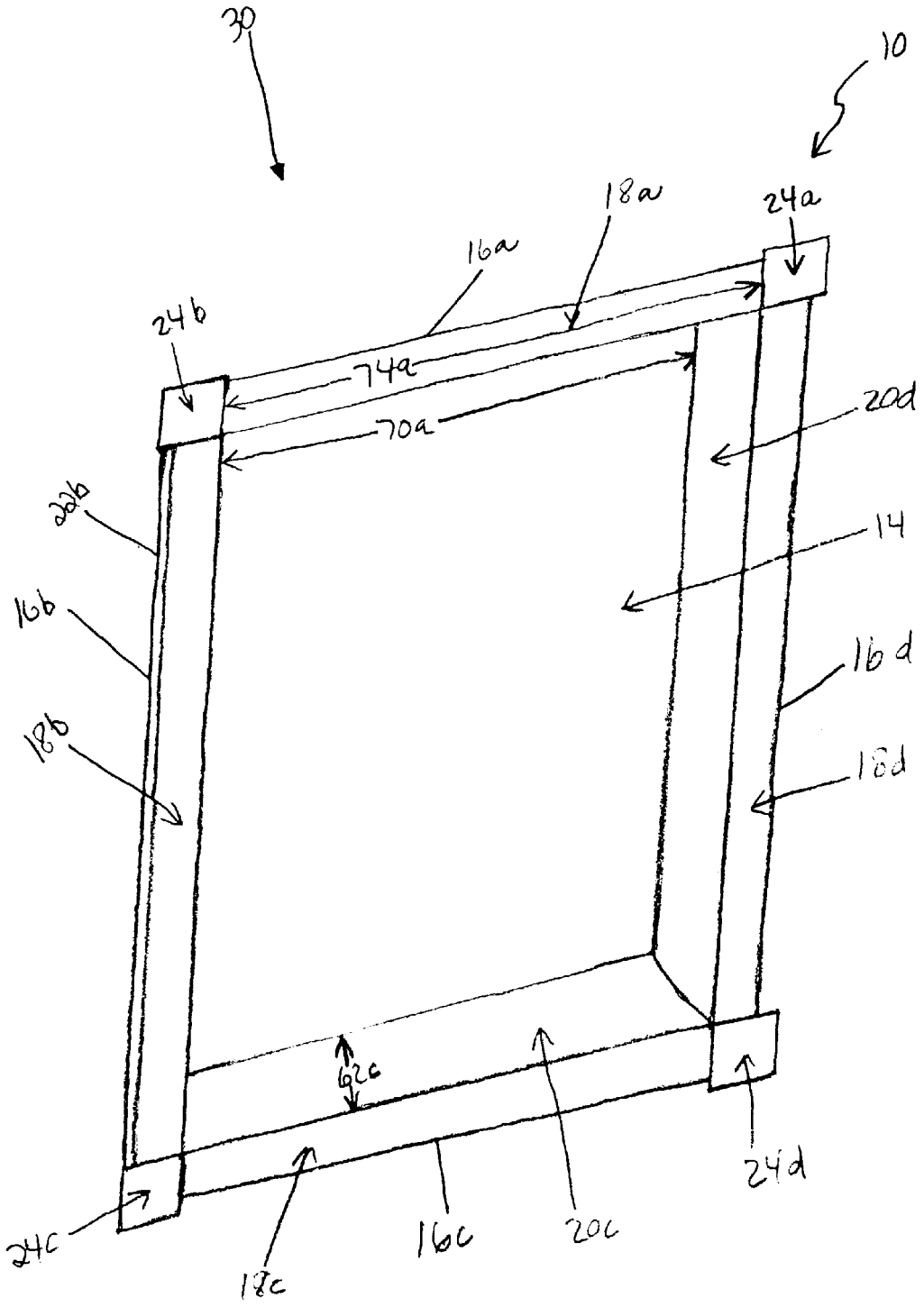
FIG. 1 illustrates a perspective view of the molded interior window frame assembly as attached to a window jamb and its surrounding wall surface.

While the invention may be susceptible to embodiments in different forms, there is shown in the drawings, and herein will be described in detail, specific embodiments with the understanding that the present disclosure is to be considered an exemplification of the principles of the invention, and is not intended to limit the invention to that as illustrated and described herein.

Referring to the drawings, FIG. 1 illustrates a molded interior frame window assembly generally as 10, a window jamb 12 (shown in FIG. 7), and a window pane 14. The molded interior frame window assembly 10 in this preferred embodiment includes four moldings 16: a top horizontal molding 16*a*, a left vertical molding 16*b*, a bottom horizontal molding 16*c*, and a right vertical molding 16*d*, all of which are identical before installation.

Figure 2:
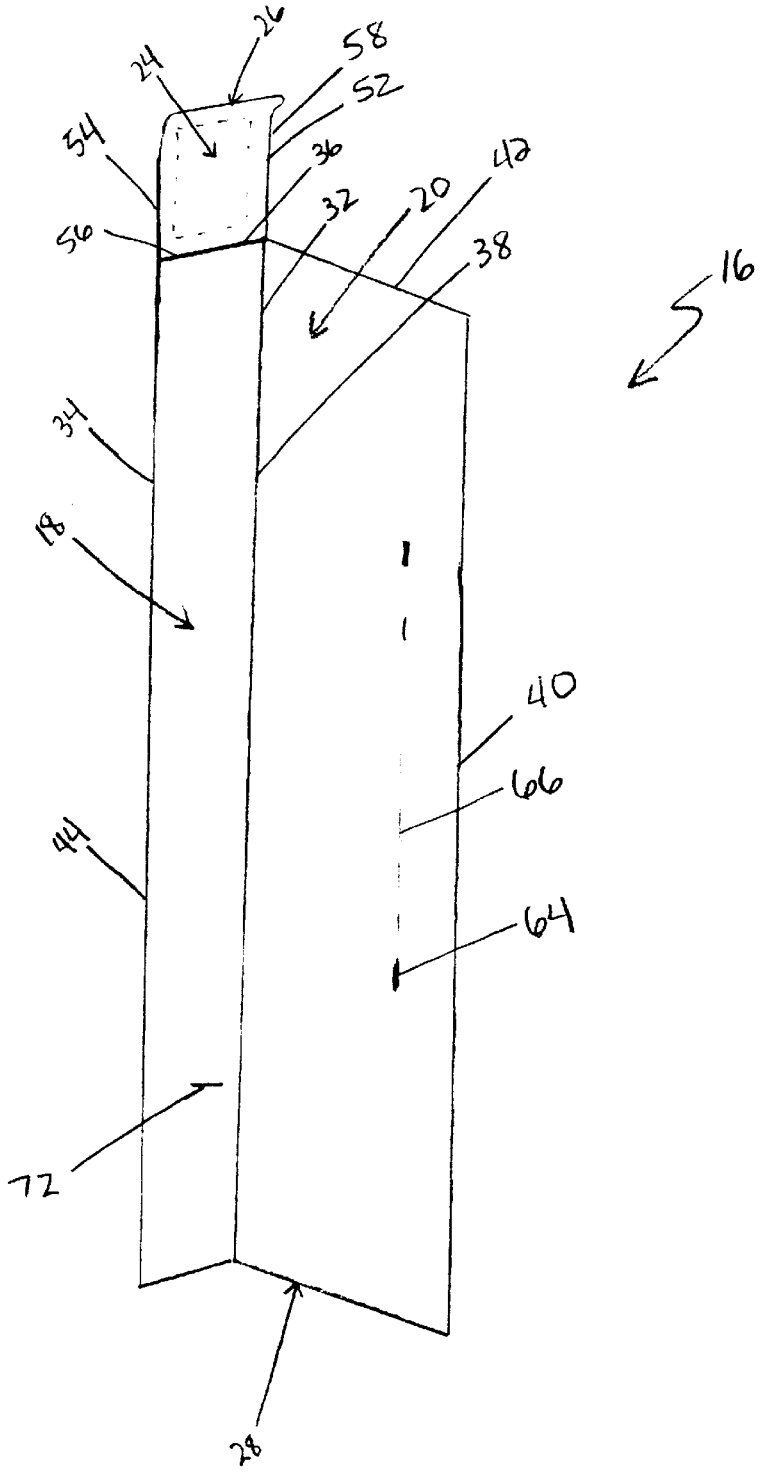
FIG. 2 illustrates a perspective view of the exterior surface of a molding section of the molded interior window frame assembly.
Figure 3:
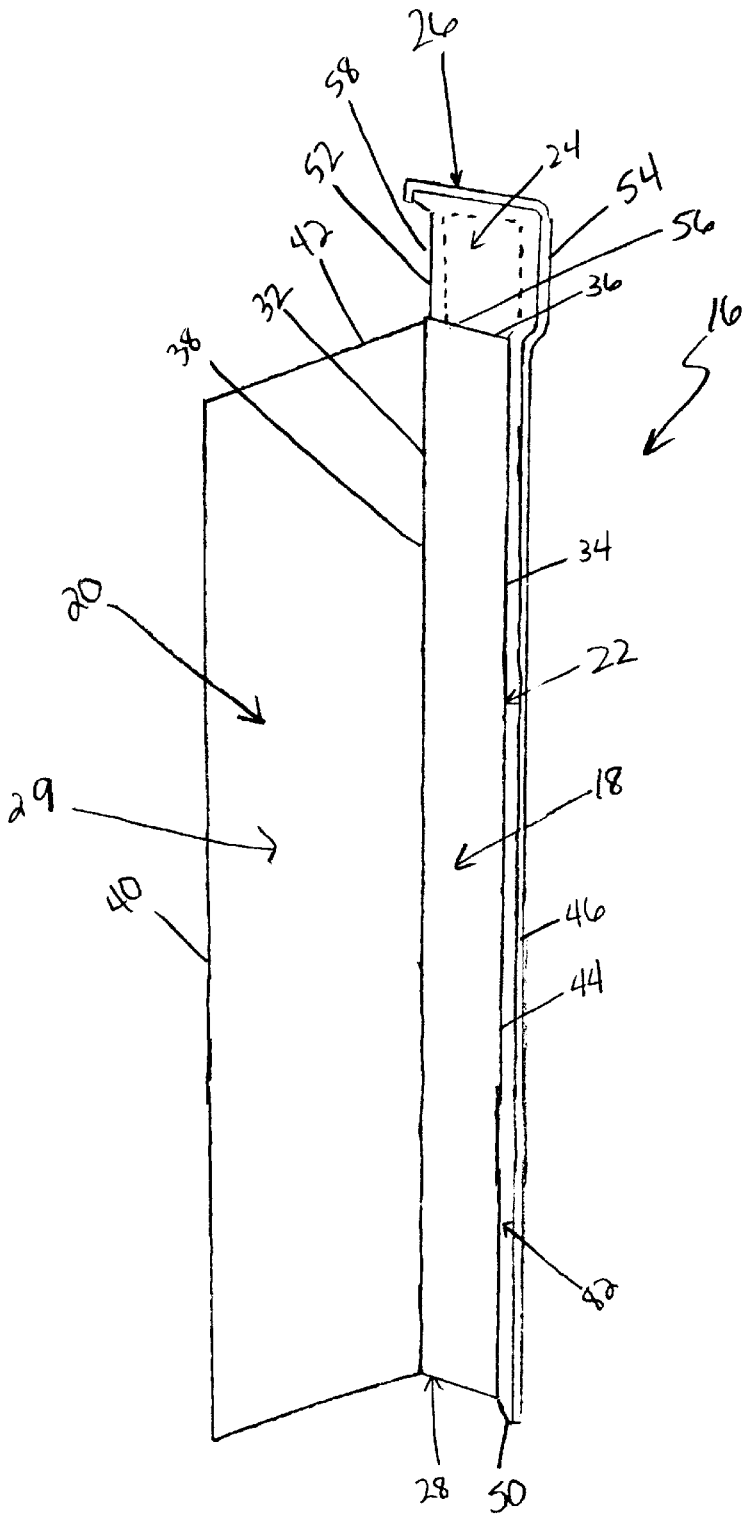
FIG. 3 illustrates a perspective view of the interior surface of a molding section of the molded interior window frame assembly.

Each molding 16 is most preferably L-shaped with a front trim 18, a jamb return 20, a trim return 22, and a cap edging 24 (shown in FIGS. 2 and 3). Each molding 16 has an upper end 26, a lower end 28, and an interior surface 29. In the preferred embodiment, the moldings 16 are formed of an acrylic. It is most preferable that the moldings 16 comprise of a DR/ABS acrylic. The acrylic can be in a variety of colors.

Each molding 16 is attached to the window jamb 12 and to the wall surface 30 which surrounds the window jamb 12. The window jamb 12 extends from the wall surface 30 to the window pane 14 which is depressed within the wall surface 30, so that the window jamb 12 is perpendicular therebetween. The window jamb 12 includes a top horizontal window jamb 12*a*, a left vertical window jamb 12*b*, a bottom horizontal window jamb 12*c*, and a right vertical window jamb 12*d*.

As shown in FIGS. 2 and 3, the front trim 18 is most preferably planar and substantially rectangular in shape, with a jamb edge 32 and a trim edge 34 which oppose each other, and a cap edge 36. In the preferred embodiment, the front trim 18 is 2⅛"wide with a length of 52".

Figure 7:
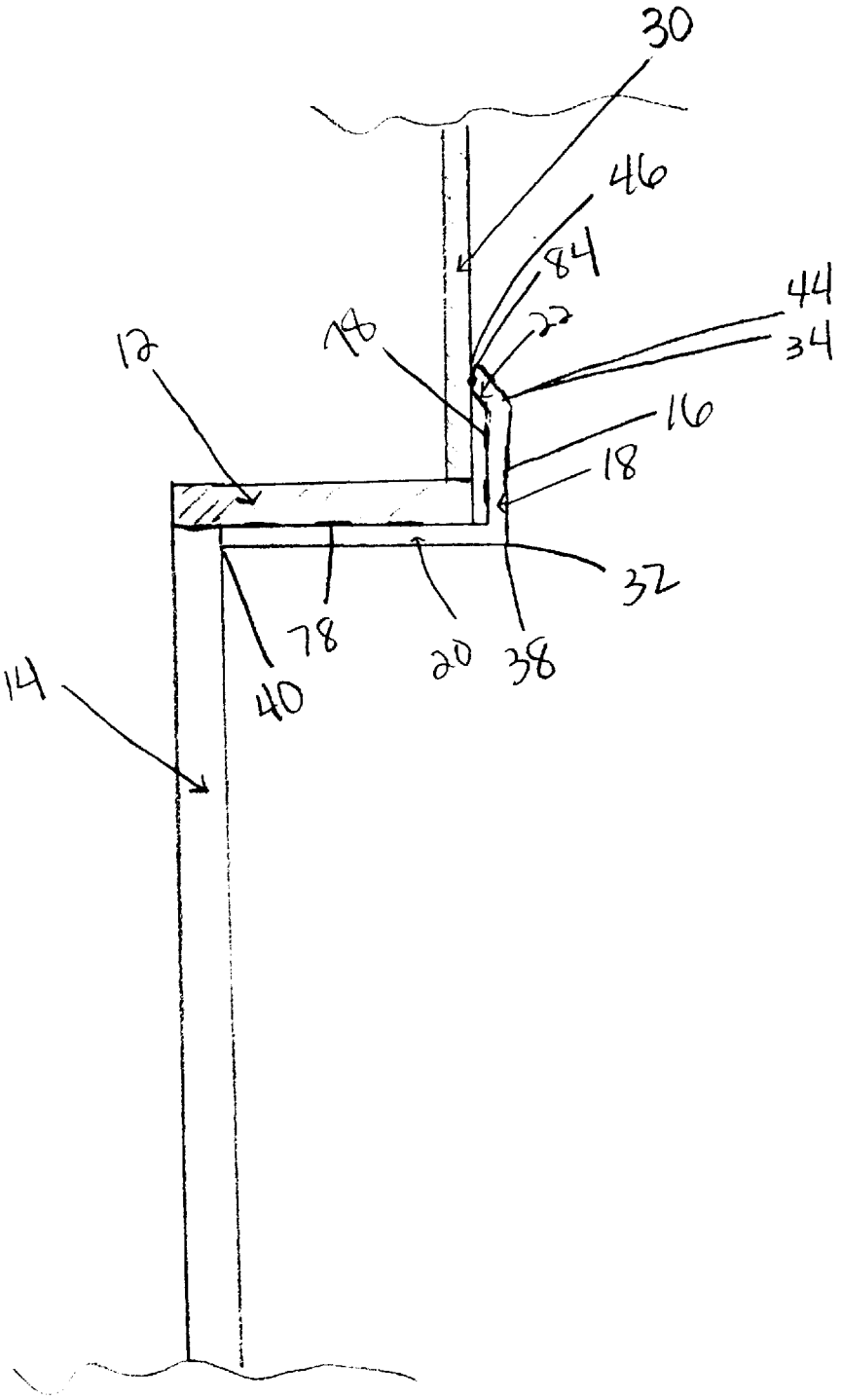
FIG. 7 illustrates a cross sectional view of a molding section of a molded interior window frame assembly installed over a window jamb.

The jamb return 20 is also planar and substantially rectangular in shape. The jamb return 20 has a front edge 38 and a window edge 40 which oppose each other, and a cap edge 42. In the preferred embodiment, the jamb return 20 is 52" long and 5" wide. As shown in FIG. 7, the jamb return 20 is perpendicularly attached to the front trim 18 along the jamb edge 32 of the front trim 18 and the front edge 38 of the jamb return 20. Once installed, the window edge 40 of the jamb return 20 substantially perpendicularly contacts the window pane 14.

The trim return 22 is planar and substantially rectangular in shape. The trim return has a front edge 44 and a wall edge 46 which oppose each other, and a bottom edge 50. In the preferred embodiment, the trim return 22 is ½" wide and 52" long. In the preferred embodiment, as shown in FIG. 7, the trim edge 34 of the front trim 18 contacts the front edge 44 of the trim return 22 to form an obtuse angle. The wall edge 46 of the trim return 22 substantially contacts the wall surface 30 at an acute angle.

The cap edging 24 has a molding edge 52 and a wall edge 54, which oppose each other, and a bottom edge 56. The molding edge 52 and further includes an indent 58. The bottom edge 56 of the cap edging 24 is attached to the cap edge 36 of the front trim 18. In the preferred embodiment the cap edging 24 is substantially dome shaped. The cap edging 24 is 2½" long, resulting in the molding 16 having a total length of 54½".

Before installation of the molded interior window frame assembly 10, any interior wood (not shown) on the wall surface 30 is to be removed. If a matching acrylic wall surround (not shown) is to be installed, this needs to be installed over the wall surface 30 prior to the installation of the molded interior window frame assembly 10.

It is most preferred that the molded interior window frame assembly 10 is installed in the counterclockwise direction. The top horizontal molding 16*a* is first installed over the top horizontal window jamb 12*a*. The installer measures the width 60*a* (not shown) of the existing top horizontal window jamb 12*a*. This width 60*a* is determined by measuring the distance from the wall surface 30 to the window pane 14 depressed within the wall surface 30. Three eighths of an inch is added to the width 60*a* in order to account for the trim return 22*a*, resulting in the jamb return width 62*a*. As shown in FIG. 2, the jamb return width 62*a* is then transferred to the jamb return 20*a* by measuring from the front edge 38*a* of the jamb return 20*a* towards the window edge 40*a* of the jamb return 20*a* at two different locations along the jamb return 20*a*. A jamb return mark 64*a* is created at each location. A line 66*a* is drawn connecting the two jamb return marks 64*a*. The jamb return 20*a* is then cut along the line 66*a* with an orbital jig saw 68 (not shown). After installation of the top horizontal molding 16*a* over the top horizontal window jamb 12*a*, the width 62*a* of the jamb return 20*a* should be approximately as wide as the width 60*a* of the window jamb 12*a*.

The opening length 70*a* of the window pane 14*a* is measured next. This length 70*a* is transferred to the front trim 18*a* by measuring from the bottom edge 56*a* of the cap edging 24*a* towards the lower end 28*a* of the top horizontal molding 16*a* and creating a front trim mark 72*a* on the front trim 18*a*. The top horizontal molding 16*a* is then cut along the front trim mark 72*a* with the orbital jig saw 68 (not shown). The orbital jig saw 68 cuts through the front trim 18*a*, the jamb return 20*a*, and the trim return 22*a*. The length 74*a* of the top horizontal molding 16*a* should be approximately as long as the length 70*a* of the window pane 14.

The top horizontal molding 16*a* is then test fitted over the top horizontal window jamb 12*a*, over which it should fit snugly. In the preferred embodiment, the cap edging 24*a* of the top horizontal molding 16*a* is located on the right side of the top horizontal window jamb 12*a*. Once the top horizontal molding 16*a* fits properly, it is then prepped for installation.

Figure 4:
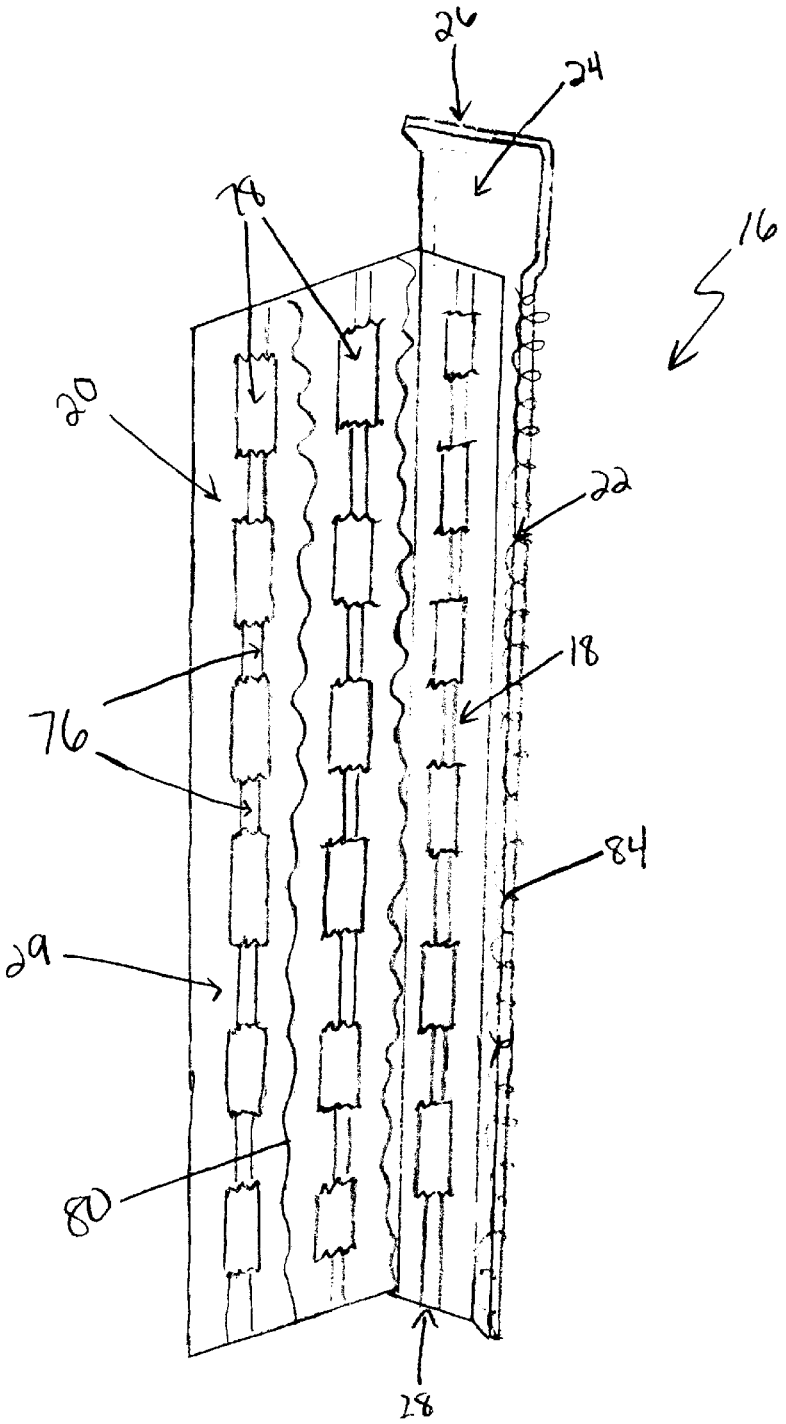
FIG. 4 illustrates a perspective view of the interior surface of a molding section of the molded interior window frame assembly with adhesive.

As shown in FIG. 4, a butyl primer 76 is bushed on the interior surface 29*a* of the top horizontal molding 16*a*. One brush width is used for every 2" of width of the top horizontal molding 16*a*. Strips of flat butyl tape 78 are then adhered onto the interior surface 29*a* over the butyl primer 76, with squeezes of silicone 80 applied between the strips of the flat butyl tape 78. Two rows of flat butyl tape 78 are also applied to the wall surface 30. If an acrylic wall surround (not shown) was not installed over the wall surface 30, butyl primer 76 is applied first. On the interior surface 82*a* of the trim return 22*a*, a single strand of round butyl tape 84 is applied. The round butyl tape 84 creates a water barrier, protecting the flat butyl tape 78 from breakage. The top horizontal molding 16*a* is then placed over the top horizontal window jamb 12*a*. In the preferred embodiment, the butyl tape 78 is applied onto the interior surface 29*a* of the top horizontal molding 16*a*. However, the butyl tape 78 could also be applied over the existing window jamb 12*a*.

Figure 5:
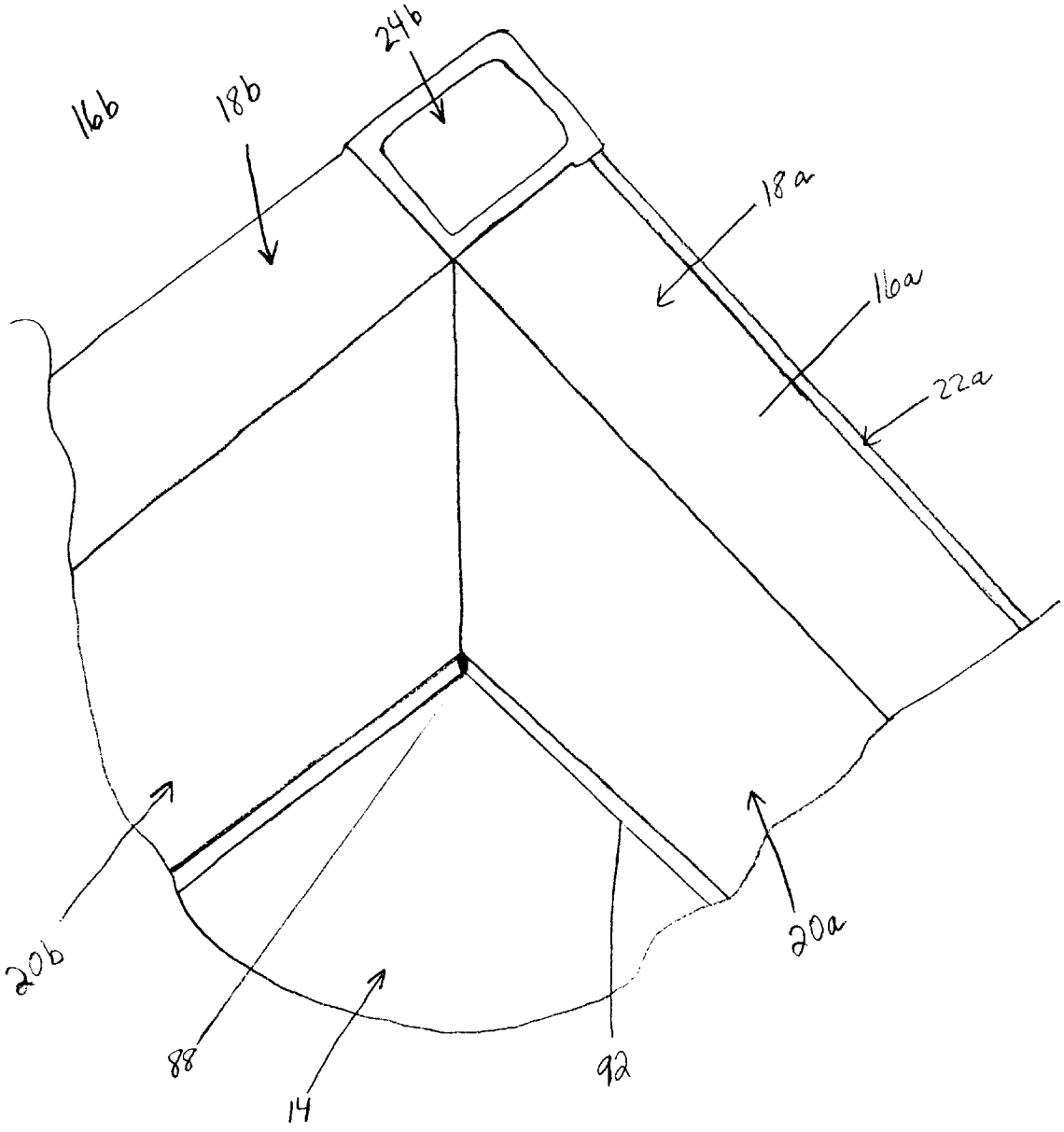
FIG. 5 illustrates a perspective view of an enlarged section of an exterior corner of a molded interior window frame assembly.
Figure 6:
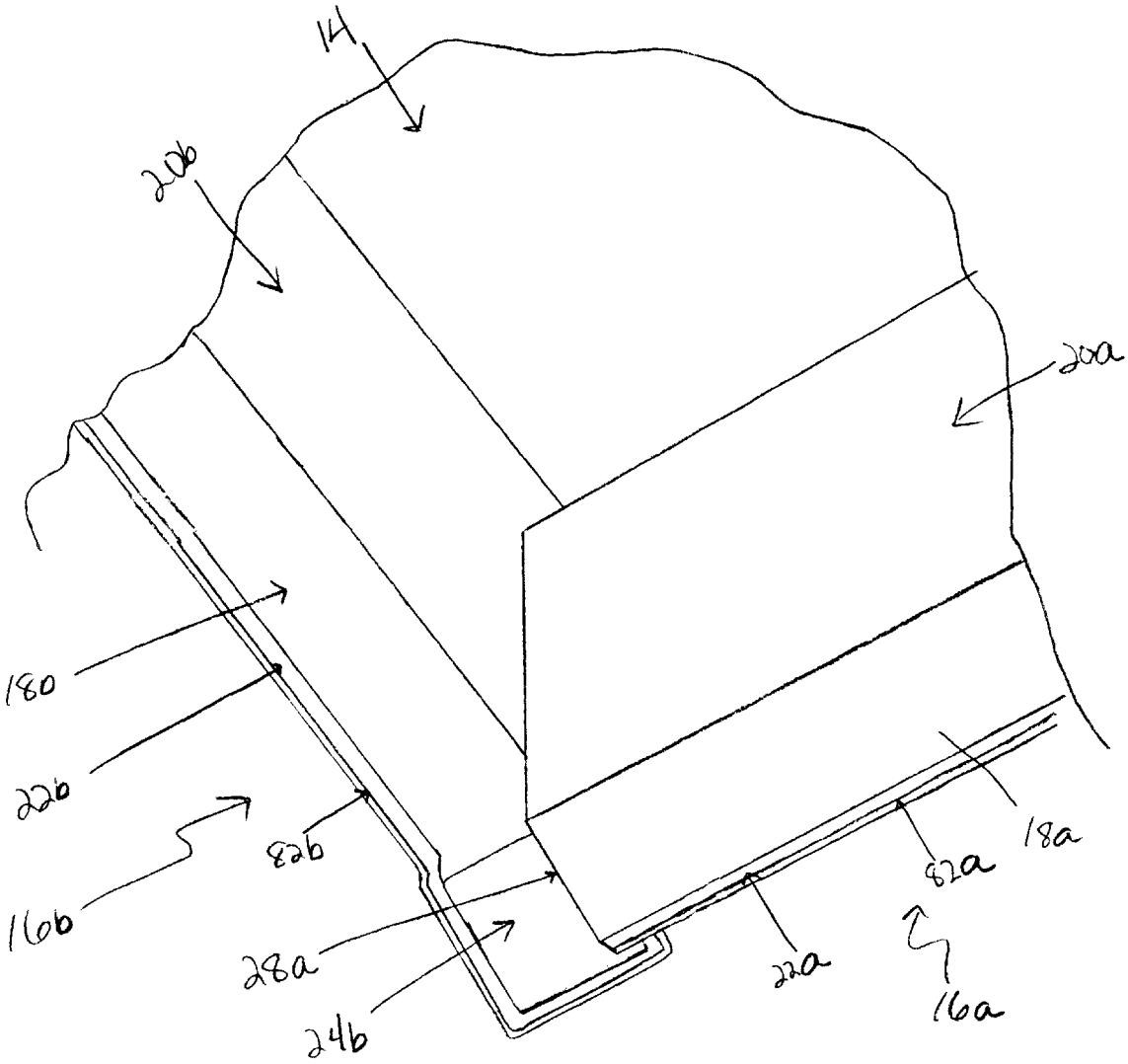
FIG. 6 illustrates a perspective view of an enlarged section of an interior corner of a molded interior window frame assembly.

This process is repeated for the installation of the left vertical molding 16*b* over the left vertical window jamb 12*b*. In this way, as shown in FIGS. 5 and 6, when the left vertical molding 16*b* is installed, the cap edging 24*b* of the left vertical molding 16*b* overlaps the lower end 28*a* of the top horizontal molding 16*a*. The lower end 28*a* of the top horizontal molding 16*a* projects through the indent 58*b* on the molding edge 52*b* of the cap edging 24*b* of the left vertical molding 16*b*. After installation, the cap edge 42*b* of the jamb return 20*b* of the left vertical molding 16*b* perpendicularly contacts the jamb return 20*a* of the top horizontal molding 16*a* proximate to the lower end 28*a* of the top horizontal molding 16*a*.

The bottom horizontal molding 16*c* and the right vertical molding 16*d* are installed over the bottom horizontal window jamb 22*c* and the right vertical window jamb, respectively, following the process detailed above for the installation of the top horizontal molding 16*a* and the left vertical molding 16*b*. However, when the right vertical molding 16*d* is to be measured and installed, the bottom edge 50*d* of the trim return 16*d* of the right vertical molding 16*d* is cut slightly oversized or mitered to form an overlap 86 (not shown). The overlap 86 of the trim return 16*d* is slipped under the indent 58*a* on the molding side 52*a* of the cap edging 24*a* of the top horizontal molding 16*a*.

Once all the moldings 16 are installed, a color matched silicone bead 88 is placed at the inside corners 90 of the window pane 14. Silicone 92 (not shown) is also applied where the molded interior frame window assembly 10 contacts the window pane 14 and the wall surface 30. A sealant finisher 94 is applied over the silicone 88 and 92 to smooth the silicone 88 and 92 and to create a neat seam appearance.

Once the molded interior window frame 10 is assembled as shown in FIG. 1, its novel advantages will become apparent. For one, the characteristics of the DR/ABS acrylic make it resistant to mold or mildew growth. Additionally, the acrylic molded interior window frame assembly 10 provides a complementary appearance to the bathroom. The molded interior window frame assembly 10 is assembled and removed with ease, and the installation process does not disturb the window pane 14. There is also no wait time for glues or mortars to set. Additionally, the molded interior window frame assembly 10 is impervious to water penetration.

While the invention has been described in connection with a preferred embodiment and several alternative embodiments, it will be understood that it is not intended that the invention be limited to those embodiments. On the contrary, it is intended to cover all alternatives, modifications and equivalents as may be included within the spirit and scope of the invention as disclosed.

As to the manner of usage and operation of the instant invention, same should be apparent from the above disclosure, and accordingly no further discussion relevant to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered illustrative of only the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The foregoing discussion is illustrative of the invention. However, since many embodiments of the invention can be made without departing from the spirit and scope of the invention, the invention resides wholly in the claims hereinafter appended.

I claim:

1. A method of constructing a window frame assembly suitable for use on a window jamb surrounding a window pane, the window jamb having a width and defining a window opening having a length in a wall surface, each of the four molding sections having an upper end, a lower end, and an interior surface wherein each of the four molding section includes a front portion with a jamb edge and an opposing trim edge, a jamb portion, a trim portion with an interior surface, and a cap, wherein the jamb portion is perpendicularly attached to the jamb edge of the front portion, the trim portion is attached to the trim edge of the front portion, and the cap is located at the upper end of each of the four molding sections, the method comprising:

a. dimensioning each of the four molding sections to overlap the width of the window jamb and to extend the length of the window opening;

b. arranging each of the four molding sections in a counter clockwise direction over the window jamb and the wall surface circumscribing the window opening; such that the cap at the upper end of each of the four molding sections overlaps the lower end of the molding section perpendicularly interconnected;

c. adhering the molding sections to the window jamb and to the wall surface; and d. finishing to the window frame assembly;

whereby the front portion substantially overlays the wall surface, the jamb portion substantially perpendicularly contacts the window surface, and the trim portion substantially contacts the wall surface.

2. A method of constructing a window frame assembly suitable for use on a window jamb surrounding a window pane, the window jamb having a width and defining a window opening having a length in a wall surface, each of the four molding sections having an upper end, a lower end, and an interior surface, wherein each of the four molding section includes a front portion with a jamb edge and an opposing trim edge, a jamb portion, a trim portion with an interior surface, and a cap, wherein the jamb portion is perpendicularly attached to the jamb edge of the front portion, the trim portion is attached to the trim edge of the front portion, and the cap is located at the upper end of each of the four molding sections, the method comprising:

a. dimensioning each of the four molding sections to overlap the width of the window jamb and to extend the length of the window opening;

b. arranging each of the four molding sections in a counterclockwise direction over the window jamb and the wall surface circumscribing the window opening such that the cap at the upper end of each of the four molding sections overlaps the lower end of the molding section perpendicularly interconnected;

c. adhering the molding sections to the window jamb and to the wall surface; and d. finishing to the window frame assembly;

whereby the front portion substantially overlays the wall surface, the jamb portion substantially perpendicularly contacts the window surface, and the trim portion substantially contacts the wall surface.

3. The method of constructing a window frame assembly as recited in claim 2 wherein each of the four molding sections is adhered to the window jamb and to the wall surface by brushing a butyl primer on the interior surface of each of the four moldings, adhering a flat butyl tape to the interior surface of each of the four moldings, applying silicon between the flat butyl tape, and applying a round butyl tape to the interior surface of the trim portion.

* * * * *